US008241127B2

(12) United States Patent
Kovacs

(10) Patent No.: US 8,241,127 B2
(45) Date of Patent: Aug. 14, 2012

(54) WIRELESS OPERATION OF A GAME DEVICE

(75) Inventor: James K. Kovacs, Reno, NV (US)

(73) Assignee: IGT, Reno, NV (US)

( * ) Notice: Subject to any disclaimer, the term of this patent is extended or adjusted under 35 U.S.C. 154(b) by 1263 days.

(21) Appl. No.: 11/204,881

(22) Filed: Aug. 16, 2005

(65) Prior Publication Data

US 2006/0046849 A1 Mar. 2, 2006

Related U.S. Application Data

(60) Provisional application No. 60/605,041, filed on Aug. 27, 2004.

(51) Int. Cl.
*A63F 9/24* (2006.01)
*A63F 9/22* (2006.01)

(52) U.S. Cl. ..... 463/39; 463/16; 463/20; 463/42

(58) Field of Classification Search ..... 463/1, 16–47; 273/36, 39, 138.1, 139, 138.2, 143 R
See application file for complete search history.

(56) References Cited

U.S. PATENT DOCUMENTS 4,799,683 A * 1/1989 Bruner, Jr. ..... 463/31
5,011,149 A 4/1991 Purnell
5,096,195 A 3/1992 Gimmon
5,168,969 A 12/1992 Mayhew
5,232,191 A 8/1993 Infanti
5,240,249 A * 8/1993 Czarnecki et al. ..... 463/11
5,242,163 A * 9/1993 Fulton ..... 463/13
5,429,363 A * 7/1995 Hayashi ..... 463/40
5,489,010 A 2/1996 Rogers
5,579,002 A 11/1996 Iggulden et al.
5,762,617 A 6/1998 Infanti
5,770,533 A * 6/1998 Franchi ..... 463/42
5,913,487 A 6/1999 Leatherman
5,999,808 A * 12/1999 LaDue ..... 455/412.2
6,091,066 A 7/2000 Sugihara
6,120,025 A 9/2000 Hughes
6,270,410 B1 * 8/2001 DeMar et al. ..... 463/20
6,293,485 B1 9/2001 Hollowed
6,422,670 B1 7/2002 Hedrick et al.
6,454,649 B1 9/2002 Mattice et al.
D474,183 S 5/2003 Mesa
6,638,166 B2 * 10/2003 Hedrick et al. ..... 463/20
6,702,672 B1 * 3/2004 Angell et al. ..... 463/25
6,846,238 B2 * 1/2005 Wells ..... 463/39
6,971,956 B2 * 12/2005 Rowe et al. ..... 463/25
2002/0123381 A1 9/2002 Akeripa (Continued)

OTHER PUBLICATIONS

Rojami Gaming Advertisement, published by Logical Extension in 2002.

(Continued)

*Primary Examiner* — Peter DungBa Vo
(74) *Attorney, Agent, or Firm* — Neal, Gerber & Eisenberg LLP

(57) ABSTRACT

A gaming device which can be operated by wireless signals provided by a remote control unit or device after an initialization process. The initialization process insures that the initialized gaming device accepts signals solely from the initialized remote control unit and that other players are prevented from operating the gaming device using a different remote control unit. The wireless signals contain gaming commands for play of a primary wagering game as well as player identification and/or player tracking information.

17 Claims, 7 Drawing Sheets

U.S. PATENT DOCUMENTS

| | | | | |
|---|---|---|---|---|
| 2002/0167486 | A1 | 11/2002 | Tan et al. | |
| 2003/0045354 | A1* | 3/2003 | Giobbi | 463/40 |
| 2003/0050117 | A1 | 3/2003 | Silva et al. | |
| 2003/0064805 | A1* | 4/2003 | Wells | 463/39 |
| 2003/0119543 | A1 | 6/2003 | Kfoury et al. | |
| 2003/0216174 | A1 | 11/2003 | Gauselmann | |
| 2004/0038725 | A1 | 2/2004 | Kaminkow | |
| 2004/0040617 | A1 | 3/2004 | Dietrich | |
| 2004/0118669 | A1 | 6/2004 | Mou | |
| 2004/0140617 | A1 | 7/2004 | Cordell | |

OTHER PUBLICATIONS

Dealer's Choice Advertisement, published by Strictly Slots, Apr. 2004.

* cited by examiner

WIRELESS OPERATION OF A GAME DEVICE

PRIORITY CLAIM

This application is a non-provisional application of, claims priority to and the benefit of U.S. Provisional Patent Application Ser. No. 60/605,041, filed Aug. 27, 2004, the entire contents of which is incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Gaming device manufacturers have endeavored for years to provide gaming devices which entertain players. Well known gaming devices provide a game with entertaining game elements such as game themes or schemes, background designs, cabinet decorations, game rules, and other aspects associated with a gaming device.

Gaming device players are sometimes inconvenienced by the operation of certain known gaming devices. For example, to initiate a play of a gaming device, a player places coins or tokens in a gaming device to make a wager. However, obtaining coinage for a gaming device, carrying the coinage to and from a gaming device and depositing the coins in the gaming device can be time-consuming and labor-intensive repetitive tasks for certain people.

Accordingly, gaming device manufacturers have provided gaming devices having devices for receiving paper currency and/or tickets and dispensing tickets. In addition, manufacturers have proposed devices for receiving and reading magnetically or otherwise coded cards. Other types of cards received by gaming devices include player tracking information cards which are prevalent throughout the gaming industry. The information generally stored on the cards respectively include credits purchased by a player and player identification information.

Although tickets and coded cards can provide added convenience in operating gaming devices, there are potential disadvantages associated with their use. The tickets and cards can be damaged or destroyed. For example, a magnetic strip on a card can be damaged, thus rendering the card unreadable. In addition, the information stored on a card can be read or processed incorrectly. Further, players can lose the cards and tickets.

To play most gaming devices, a player must physically touch the gaming device to at least make a wager and initiate a game. Many players repeatedly play the same game and repeatedly make the same bet or wager. While these acts are a significant part of the enjoyment for many players, some players may quickly tire of making such physical acts even though they want to repeatedly play the gaming device. Additionally, many players such as senior citizens and disabled people have found that repeatedly physically touching the gaming device can be physically difficult.

One known wireless gaming device is disclosed in U.S. Pat. No. 6,270,410. This patent discloses a gaming system with a slot machine and a portable controller such as a remote control. In one embodiment, the controller includes a battery operated hand-held controller and, most preferably, a light weight remote control. The portable controller is operatively associated with and spaced from the slot machine to remotely play a game on the slot machine. In one embodiment, the controller has at least one button such as a one play or spin button. In another embodiment, the controller has a set of buttons to cause various other events to occur such as cashing out the accumulated credits or playing multiple games in a row. When a button is pushed on the remote control, a signaling light extending from the remote control generates and emits a visual signal which is transmitted to a receptor, such as a receptor light, on the front of the slot machine to remotely actuate and control the slot machine. However, this patent does not appear to disclose a gaming device with the ability to detect the presence/alignment of a remote control unit and automatically begin an initialization process. Nor does this patent appear to disclose a gaming device with the ability to transmit signals to the remote control (such as for messaging, advertisements, and player account updates). Moreover, this patent does not appear to disclose a remote control unit that is operable to receive wireless signals from the gaming device, operable with a specific initialized gaming device and operable to store player credit information.

Accordingly, there is a need for a gaming device which enables players to make wagers and play a game without repeatedly physically touching the gaming device wherein the gaming device is also operable to detect the presence/alignment of a remote control unit and automatically begin an initialization process, and further operable to transmit signals to the remote control (such as for messaging, advertisements, and player account updates). Moreover, there is a need for a remote control unit that is operable to receive wireless signals from the gaming device, operable with a specific initialized gaming device and further operable to store player credit information and enable players to input credits into the gaming device via the remote control unit.

SUMMARY OF THE INVENTION

One embodiment of the present invention provides a gaming device which is at least partially operated by a wireless signal from a remote control unit or device that enables a player to wirelessly operate the gaming device from a distance.

In one embodiment, in addition to the conventional features of a gaming device, such as a cabinet, at least one display device connected to a processor and at least one input device connected to the processor, the gaming device of one embodiment of the present invention includes at least one signal receiver connected to the processor. The signal receiver is adapted to receive wireless signals from a remote control unit, convert the received wireless signal into electronic signals and communicate the electronic signals to the gaming device processor. The gaming device processor interprets the received signal and performs or controls at least one game related or other suitable function accordingly. For example, the player may place a wager in a primary game by sending a signal from the remote control unit to the gaming device, rather than pressing a wager button on the gaming device.

In one embodiment, the signals received from the remote control unit include any suitable game play command or game play wager option. In one embodiment, the signals may also include any suitable player identification information, such as a player's name, address and/or player tracking account. In other embodiments, the signals include any other suitable information, such as advertisements, personalized messages or synchronization data. It should be appreciated that any suitable bandwidth or any suitable wireless signal, such as a radio signal, an infrared signal, a laser signal or a microwave signal may be implemented with the present invention. In certain embodiments, such signals are suitably encrypted.

In one embodiment, the signal receiver is mounted within, adjacent to or on the exterior of the cabinet. In this embodiment, to send a wireless signal to the gaming device, the player directs the remote control unit towards the signal receiver of the gaming device and operates the remote control unit. In another embodiment, the signal receiver is located within the gaming device, behind an input slot. In one embodiment, the input slot is located in the front of the cabinet of the gaming device, adjacent to at least one input device. In this embodiment, the player directs the remote control unit toward the input slot when sending signals to the gaming device. In another embodiment, the input slot is suitably sized to receive at least a portion of the remote control unit. In this embodiment, the player may use the remote control unit to send signals to the gaming device while the unit is in the input slot or may use any input device of the gaming device. In one embodiment, the insertion of the remote control unit into the input slot is used and/or necessary for the initialization process for the remote control unit with the gaming device before the remote control unit is used for play of that gaming device. This physical connection of the remote control unit and gaming device (and the accompanying electrical or other similar connection) provides a more secure communication process for the remote control device and gaming device, especially for the initialization process.

In another embodiment, in addition to receiving signals from the remote control unit, the gaming device is adapted to transmit signals to the remote control unit. In this embodiment, the gaming device includes a signal generator connected to the processor. The signal generator is connected to a signal transmitter which is adapted to transmit wireless signals to the remote control unit or any other suitable external source. In this embodiment, the signals include any suitable game play information, any suitable player identification information or any other suitable information, such as advertisements, personalized messages or synchronization data.

One embodiment of the remote control unit includes a suitably sized housing or body, a microprocessor and at least one input device, such as a button, mounted on the top of the housing and connected to the microprocessor. The remote control also includes a signal generator mounted in the housing and connected to the microprocessor, a signal transmitter mounted to the housing and connected to the signal generator and at least one communication port at one end of the housing through which any signal is sent. In this embodiment, when the input device is pressed, the microprocessor sends an electronic signal associated with a gaming command to the signal generator. The signal generator interprets the signal and generates a corresponding wireless signal. The wireless signal is communicated to the signal transmitter, which transmits the signal through the communication port to the signal receiver of the gaming device.

In one embodiment, the remote control unit includes at least one memory device connected to the microprocessor. The memory device is adapted to store any suitable player information, such as the player's name, player tracking account and/or player's financial information. In one such embodiment, the remote control unit is personal to the player and can be used by the player for various gaming devices. In one such embodiment, the remote control unit includes a suitable secure access or passcode procedure which requires the player to verify that they are the correct user of the remote control unit before being able to use the remote control unit.

In one embodiment, the remote control unit has at least one display device connected to the microprocessor and adapted to display information, including gaming information, personalized messaging, advertisements, and the like. In one embodiment, the display device is mounted on the top of the housing or body. The display device may be one or more LEDs, LCDs or any other suitable display mechanisms.

In one embodiment, the remote control unit has a plurality of input devices, such as buttons or indicators connected to the microprocessor which correspond to a plurality of gaming functions. For example, the remote control unit has individual input devices for placing a wager, collecting credits, increasing the wager, decreasing the wager, changing games and obtaining information regarding the game. In another embodiment, the remote control unit has input devices for enabling the player to toggle through a plurality of selections and choose one of the selections.

In one embodiment, the remote control unit is capable of receiving a wireless signal through the communication port. The signal is interpreted by a signal receiver mounted in the housing and connected to the microprocessor. The signal receiver converts the signals it receives into electronic signals and sends the electronic signals to the microprocessor. The microprocessor uses such information accordingly, such as storing such information in a storage device connected to the microprocessor or causing the display device to display information to the player.

In one embodiment, when a remote control unit is used to operate a gaming device, an initialization process occurs prior to remote operation of the gaming device. In this embodiment, the remote control unit is first generally aligned with the signal receiver of the gaming device. Once aligned, an initialization device, such as a button, on the remote control unit is pressed to send a signal to the signal receiver of the gaming device. The signal contains synchronization data, such as a personal identification code for the remote control unit, which enables the remote control unit to operate the specified gaming device. The signal may also contain any other suitable information, such as a player identification and/or wager information. The gaming device interprets, stores and acknowledges the remote control synchronization data. Once a gaming device and remote control unit are synchronized, the gaming device is only operable with a specific remote control unit and the specific remote control unit is only operable with the specific gaming device. As indicated above, this initialization process may require a physical coupling between the remote control and the gaming device to provide for a more secure initialization process. After the process or part of the process is complete, the remote control unit may be removed from the gaming device and used to play the gaming device. Alternatively, the remote control unit maybe left physically connected to the gaming device and the player may operate the gaming device using the remote control unit and/or the input devices of the gaming device.

This initialization process insures that the initialized gaming device accepts signals solely from the remote control unit having the specific stored personal identification code. That is, once synchronized, other players are prevented from operating the gaming device using a different remote control unit. This feature provides increased security and in one embodiment enabling the player to store game play credits on the remote control unit without the potential that the stored credits can be inadvertently deposited onto a different gaming device which the player is merely passing by. This feature also provides increased security by enabling that when a player deposits funds into a specific gaming device, the funds may only be cashed out and transferred to the initialized remote control unit and not another remote control controlled by another player. Its should also be appreciated that a suitable termination process may be employed between the remote control unit and the gaming device to terminate a play session of the gaming device. In one embodiment, this may also require the physical coupling of the remote control unit and the gaming device (such as the remote control unit being inserted into the remote control input slot of the gaming device).

The present invention also provides a convenient method for operating a gaming device through wireless signals. That is, by not having to perform the tasks of inserting or swiping cards, pressing buttons on the gaming device, inserting coins, or tokens, or pulling levers, a player operates the gaming device with added comfort and convenience. Moreover, the present invention provides a system wherein a specific gaming device may be synchronized with a specific remote control unit and once synchronized, the gaming device and remote control unit are operable to exclusively function with each other.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1:
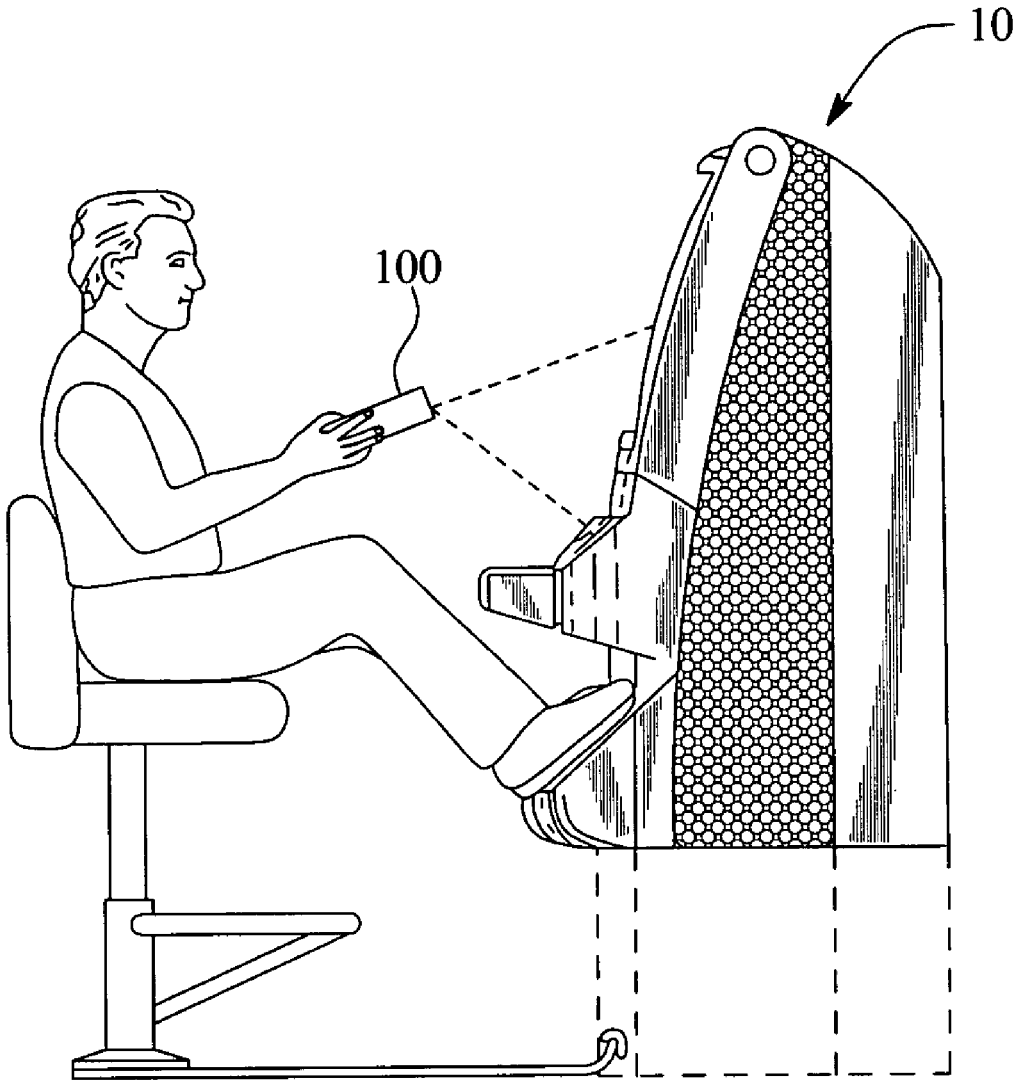
FIG. 1 is a side view of a player operating a gaming device using a remote control unit of one embodiment of the present invention.

Referring now to the drawings, FIG. 1 illustrates that in one embodiment of the present invention, a player uses a remote control unit 100 to operate a gaming device 10. In this embodiment, the remote control unit communicates with the gaming device via one or more wireless signals. That is, the player can press the appropriate button(s) on the remote control unit which corresponds to a gaming command to be executed by the processor of the gaming device. Additionally, in the present invention, the remote control unit may be utilized for such purposes as cashless gaming, player tracking, game customization and/or data transfer. This embodiment provides added comfort and convenience in comparison to conventional methods of operating gaming devices, such as by depositing coins or tokens, or pulling levers and pressing buttons located on the gaming device.

In one embodiment, the signals received from the remote control unit include any suitable game play command or game play wager option. In one embodiment, the signals include any suitable player identification information, such as a player's name, address and/or player tracking account number. In one embodiment, the signals include any other suitable information, such as advertisements, personalized messages or synchronization data. It should be appreciated that any suitable wireless signal, such as a radio signal or an infrared signal may be implemented with the present invention.

Figure 2A:
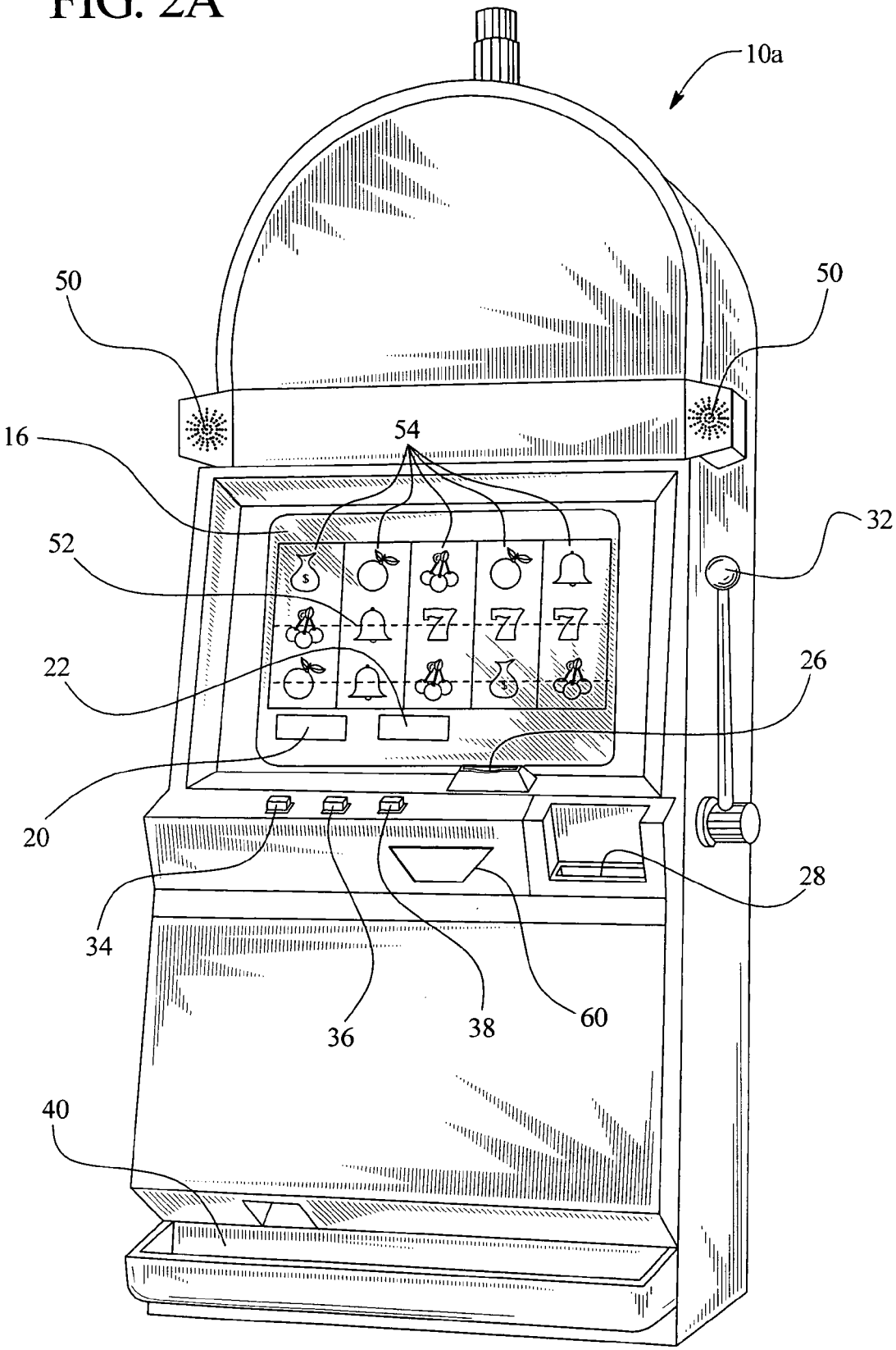
FIGS. 2A and 2B are perspective views of alternative embodiments of the gaming device of the present invention.
Figure 2B:
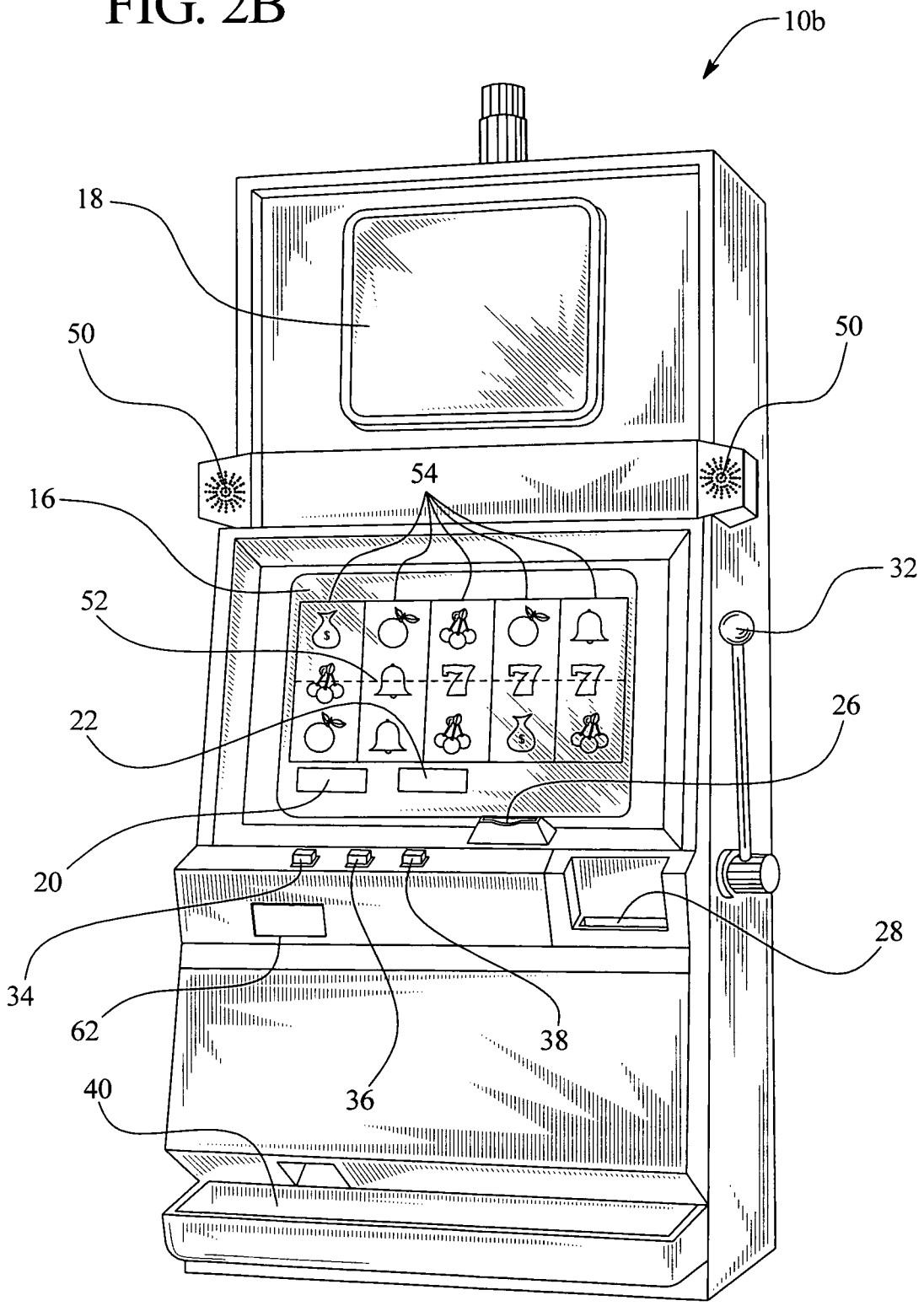

FIGS. 2A and 2B illustrated two alternative embodiments of the gaming device of the present invention as gaming device 10*a* and gaming device 10*b*, respectively. Gaming device 10*a* and/or gaming device 10*b* are generally referred to herein as gaming device 10.

In one embodiment, as illustrated in FIGS. 2A and 2B, gaming device 10 has a support structure, housing or cabinet which provides support for a plurality of displays, inputs, controls, remote control interfaces and other features of a conventional gaming machine. It is configured so that a player can operate it while standing or sitting. The player may operate the gaming machine either at the gaming machine or at a reasonable distance from the gaming machine with the use of a remote control unit as discussed in more detail below. The gaming device may be positioned on a base or stand or can be configured as a pub-style table-top game (not shown) which a player can operate preferably while sitting. As illustrated by the different configurations shown in FIGS. 2A and 2B, the gaming device can be constructed with varying cabinet and display configurations.

Figure 3A:
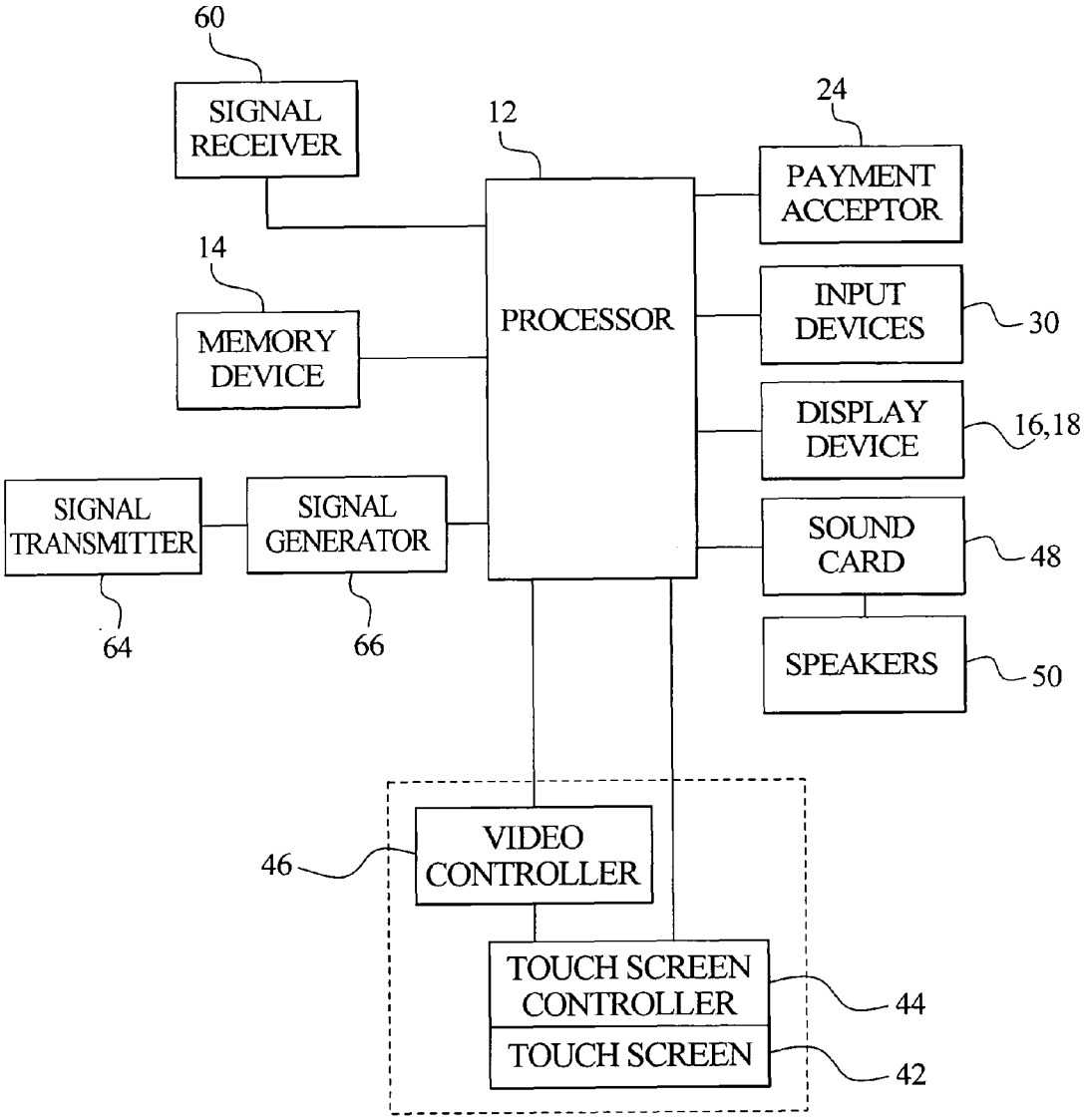
FIG. 3A is a schematic block diagram of the electronic configuration of one embodiment of one embodiment of the gaming device of the present invention.

In one embodiment, as illustrated in FIG. 3A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk, CD ROM, smartcard, memory stick, Compact Flash memory module or USB removable flash drive. A player can use such a removable memory device in a desktop, a laptop personal computer, a personal digital assistant (PDA) or other computerized platform. The processor and memory device may be collectively referred to herein as a "computer" or "controller."

In one embodiment, as illustrated in FIGS. 2A and 3A, the gaming device includes a signal receiver 60 mounted on or adjacent to the cabinet. In another embodiment (not shown), the gaming device includes a plurality of signal receivers located at a plurality of different positions on or adjacent to the cabinet. In one embodiment, at least one signal receiver is mounted on or adjacent to the exterior of the front cabinet of the gaming device. The signal receiver is in communication with the processor and is adapted to receive wireless signals from a remote control unit. That is, the signal receiver is adapted to receive wireless signals from the remote control unit, convert the received wireless signal into electronic signals and communicate the electronic signals to the gaming device processor. The gaming device processor interprets the received signals and performs at least one game related or other suitable function accordingly. For example, the player may place a wager in a primary game or select a card to discard in a primary poker game by sending a signal from the remote control unit to the gaming device.

As illustrated in FIG. 2B, in another embodiment, the signal receiver is located within the gaming device behind an input slot 62. In one embodiment, the input slot is located in the front of the cabinet of the gaming device, adjacent to the gaming device control features. In this embodiment, the input slot is suitably sized to receive at least a portion of the remote control unit. That is, the player may use the remote control unit to send signals to the gaming device while the unit is engaged with the input slot. In another embodiment, the slot may also be utilized to facilitate the initialization of the remote control unit with the gaming device and/or the termination process of use of the remote control unit with the gaming device. This provides additional security during such processes.

As illustrated in FIG. 3A, in an alternative embodiment, the processor is in communication with a signal generator 66 for generating signals and a signal transmitter 64 for transmitting/exchanging signals to the remote control unit. In this embodiment, the signal generator generates a signal on command from the gaming device processor. The signal generator communicates the signal to the signal transmitter which converts the signal to a wireless signal and transmits the signal to a signal receiver of the remote control unit or any other suitable external source. In this embodiment, the signals sent from the gaming device include any suitable game play information, any suitable player identification information or any other suitable information, such as advertisements, personalized messages or synchronization data.

In one embodiment, as discussed in more detail below, the gaming device randomly generates awards and/or other game outcomes based on probability data. That is, each award or other game outcome is associated with one or more probabilities and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 3A, the gaming device includes one or more display devices controlled by the processor. The display devices are preferably connected to or mounted to the cabinet of the gaming device. The embodiment shown in FIG. 2A includes a central display device 16 which displays a primary game. This display device may also display any secondary game associated with the primary game as well as information relating to the primary or secondary game. The alternative embodiment shown in FIG. 2B includes a central display device 16 and an upper display device 18. The upper display device may display the primary game, any suitable secondary game associated with the primary game and/or information relating to the primary or secondary game. As seen in FIGS. 2A and 2B, in one embodiment, the gaming device includes a credit display 20 which displays a player's current number of credits, cash, account balance or the equivalent. In one embodiment, gaming device includes a bet display 22 which displays a player's amount wagered. In another embodiment, the remote control unit includes a display device which displays a player's current number of credits, cash, account balance, amount wagered, advertisements, personal messages or any other suitable information.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, rectangle, or elongated rectangle.

The display devices are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 3A, in one embodiment, the gaming device includes at least one payment acceptor 24 in communication with the processor. As seen in FIGS. 2A and 2B, the payment acceptor may include a coin slot 26 and a payment, note or bill acceptor 28, where the player inserts money, coins or tokens. The player can place coins in the coin slot or paper money, tickets or vouchers into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a suitable smartcard having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above. In one embodiment, signal received from the remote control unit (via the signal receiver) function to notify the processor of the gaming device that the player has utilized the remote control unit to transfer the appropriate amount of funds to activate the gaming device. In this embodiment, a memory device of the remote control unit stores credit or other funding information and the remote control unit is operable to transfer such funding information to the gaming device.

As seen in FIGS. 2A, 2B and 3A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 (on the gaming device or a remote control unit) which is used by the player to start any primary game or sequence of events in the gaming device if the player is not using the remote control unit or alternatively to such use. The play button can be any suitable play activator such as a bet one button, a max bet button or a repeat the bet button.

In one embodiment, as shown in FIGS. 2A and 2B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device. In one embodiment, upon appropriate funding, the gaming device begins the game play automatically. In another embodiment, upon the player engaging one of the play buttons, the gaming device automatically activates game play.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 3A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as remote control units, external video sources, expansion buses, game or other displays, a SCSI port or a key pad.

In one embodiment, as seen in FIG. 3A, the gaming device includes a sound generating device controlled by one or more sound cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. In another embodiment, the sound generating device of the gaming device is operable to generate and transmit a sound signal (via the signal generator and signal transmitter) to the remote control unit. In this embodiment, at least one sound originating at the gaming device is generated or played by the remote control unit. During idle periods, the gaming device and/or the remote control unit may display a sequence of audio and/or visual attraction messages to attract potential players to the gaming device. The videos may also be customized for or to provide any appropriate information.

In one embodiment, the gaming device may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia. In another embodiment, the gaming device is operable to acquire an image, generate and transmit an image signal (via the signal generator and signal transmitter) to the remote control unit. In this embodiment, the remote control unit is operable to display the image acquired from the sensor or camera of the gaming device.

Gaming device 10 can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video keno, video bingo or any other suitable primary or base game may be implemented into the present invention.

In one embodiment, as illustrated in FIGS. 2A and 2B, a base or primary game may be a slot game with one or more paylines 52. The paylines may be horizontal, vertical, circular, diagonal, angled or any combination thereof. In this embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active payline or otherwise occur in a winning pattern.

In one embodiment, a base or primary game may be a poker game wherein the gaming device enables the player to play a conventional game of video poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons, via the touch screen or via the remote control unit. The player then presses the deal button and the unwanted or discarded cards are removed from the display and replacement cards are dealt from the remaining cards in the deck. This results in a final five-card hand. The final five-card hand is compared to a payout table which utilizes conventional poker hand rankings to determine the winning hands. The player is provided with an award based on a winning hand and the credits the player wagered.

In another embodiment, the base or primary game may be a multi-hand version of video poker. In this embodiment, the player is dealt at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferable a plurality of the selectable indicia or numbers via an input device, via the touch screen or via the remote control unit. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 2A and 2B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game, rather they must win or earn entry through play of the primary game and thus, play of the primary game is encouraged. In another embodiment, qualification of the bonus or secondary game could be accomplished through a simple "buy in" by the player if, for example, the player has been unsuccessful at qualifying through other specified activities.

Figure 3B:
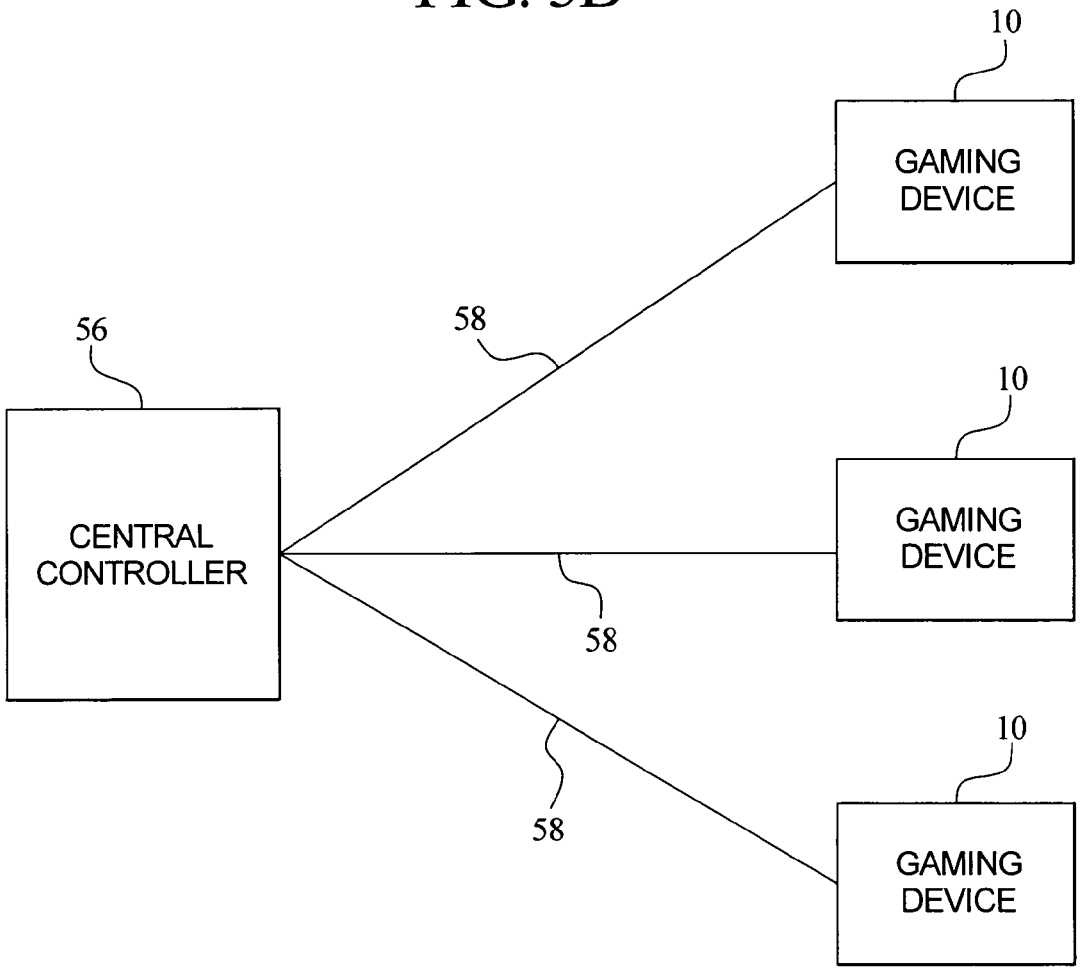
FIG. 3B is a schematic block diagram illustrating a plurality of gaming devices of one embodiment of the present invention in communication with a central controller.

In one embodiment, as illustrated in FIG. 3B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

The Remote Control Unit

Figure 4A:
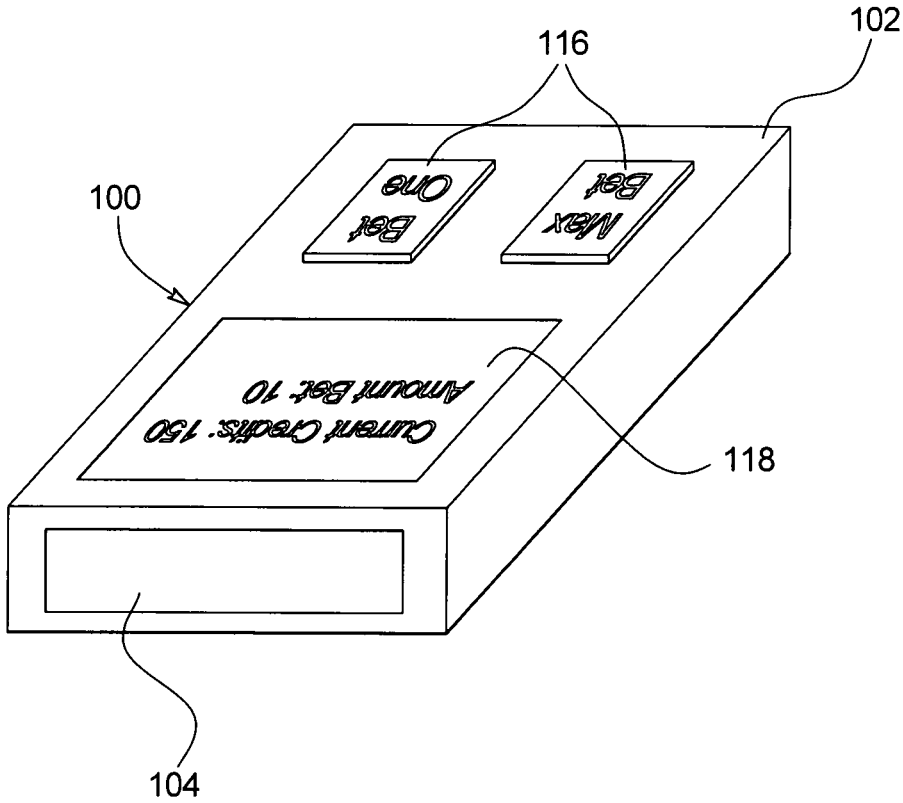
FIGS. 4A and 4B are perspective views of one embodiment of a remote control unit of the present invention.
Figure 4B:
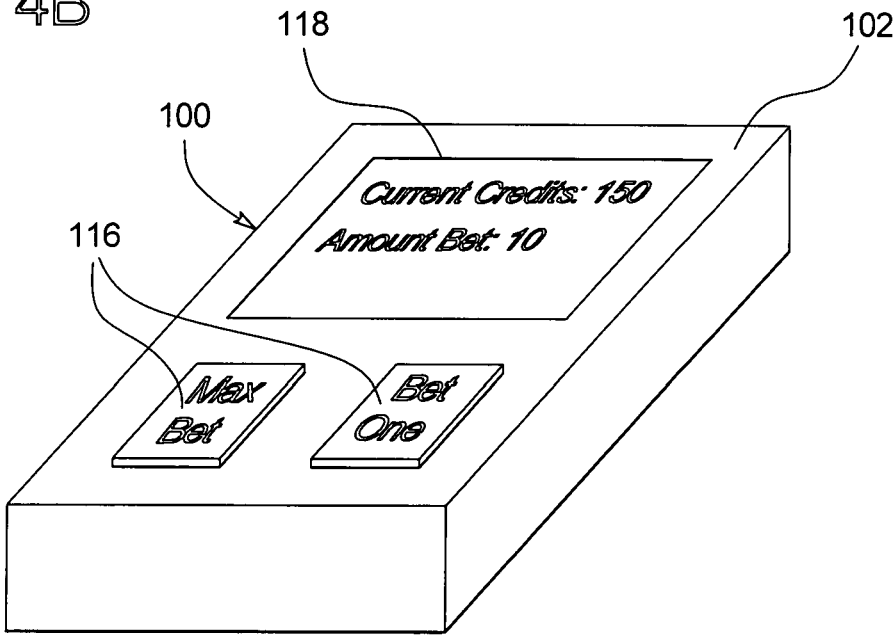

Referring now to FIGS. 4A and 4B, in one embodiment, the remote control unit 100 includes a body or housing 102 constructed from any suitable material which provides support for a plurality of displays, inputs, controls, transmitters or other suitable features. The remote control unit is of suitable weight, size and preferably of a suitable ergonomic design to enable a player to comfortably hold the remote control unit for prolonged periods of time. In one embodiment, the remote control unit includes at least one bidirectional communication port 104 located along at least one end of the housing through which a signal is sent and/or received. In alternative embodiments, the remote control unit has two or more ports.

Figure 5:
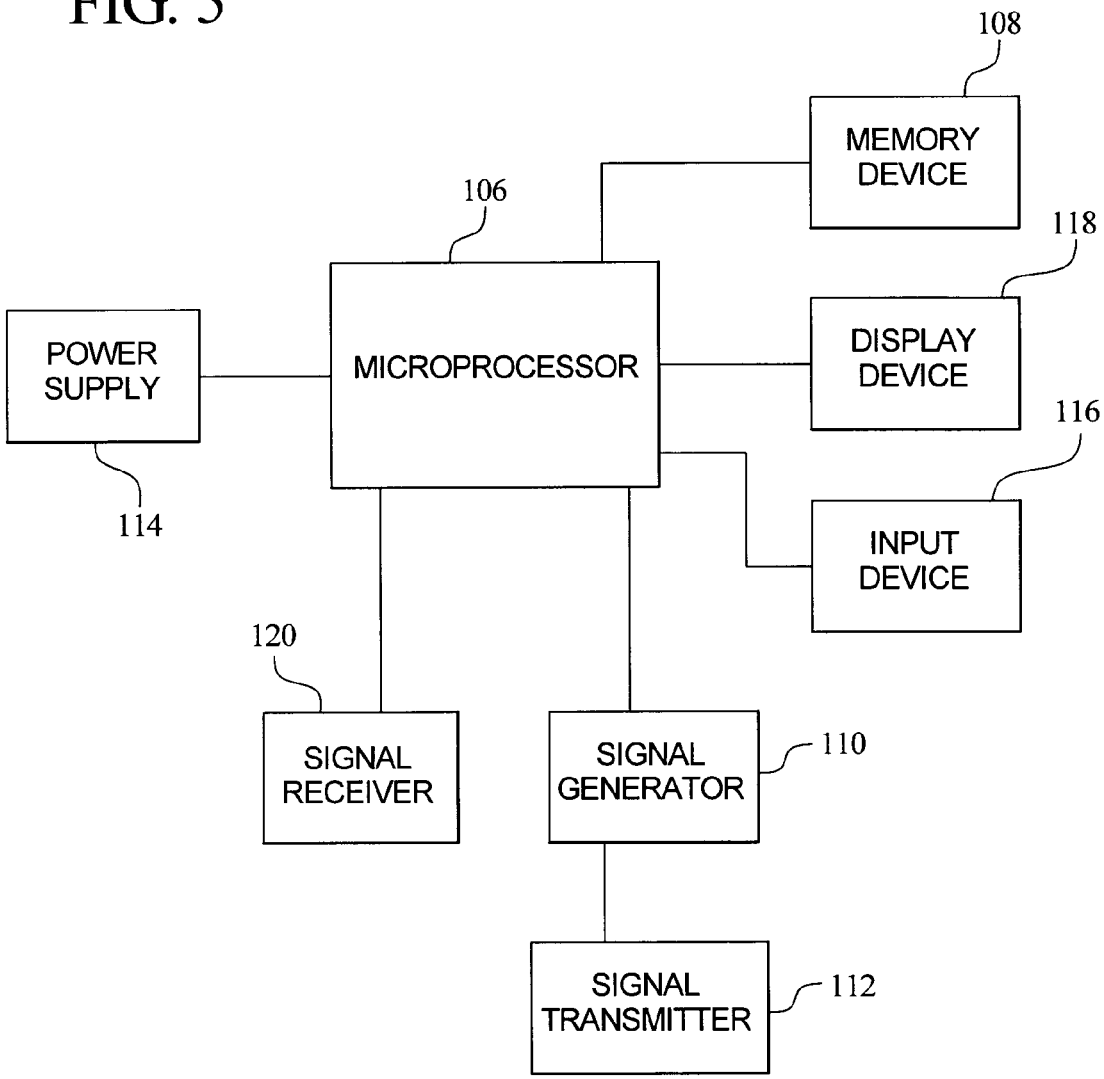
FIG. 5 is a schematic block diagram of the electronic configuration of one embodiment of the remote control unit of the present invention.

In one embodiment, as illustrated in FIG. 5, the remote control unit 100 includes at least one microprocessor 106. In one embodiment, the microprocessor is in communication with, operable to access or to exchange signals with at least one data storage or memory device 108 in the housing of the remote control unit. The memory device stores player personal identification information, game play information and/or other suitable data. The remote control includes a signal generator 110 mounted to the housing and in communication with the microprocessor. The remote control includes a signal transmitter 112 mounted to the housing adjacent to the communication port and in communication with the signal generator. The remote control includes a power supply 114 in communication with the microprocessor and mounted to the housing. The power supply is adapted to provide power to the remote control unit to enable a plurality of wireless signals to be transmitted from the remote control unit.

In one embodiment, the remote control includes at least one player operable input device 116, such as button or indicator mounted to the housing and connected to the microprocessor which corresponds to at least one gaming command (i.e., bet one, max bet, increase wager, decrease wager). In another embodiment, the remote control unit includes a plurality of player operable input devices, such as multi-purpose buttons or indicators mounted to the housing and connected to the microprocessor which correspond to a plurality of gaming commands. For example, as illustrated in FIGS. 4A and 4B, in one embodiment, the gaming device includes a Max Bet button and a Bet One button, however it should be appreciated that these multi-purpose buttons may correspond to different gaming commands during a single play of the primary and/or secondary game. In another embodiment, the buttons or indicators enable the player to toggle through a plurality of selections and choose one of the selections. For example, in this embodiment, a first button enables a player to toggle through the amounts to be wagered and a second button enables the player to select an amount to be wagered. It should be appreciated that any suitable number of buttons or indicators may be employed with the present invention.

When an input device, such as a button of the remote control unit is pressed, engaged or actuated by the player, the microprocessor sends an electronic signal associated with a gaming command to the signal generator. The signal generator interprets the signal and generates a corresponding electronic signal. The electronic signal is communicated to the signal transmitter, which sends the signal through the communication port to the signal receiver of the gaming device. This enables the player to send a conventional gaming command to the gaming device using the remote control unit.

In one embodiment, the remote control unit includes at least one display device or visual indicator 118 in communication with the microprocessor. The remote control display device is mounted on the top of the housing and is of appropriate size and shape to display suitable text and/or animation. The remote control display device may include, without limitation, a monitor, a television display, a plasma display, a LCD, a LED or any other suitable electronic device or display mechanism. The remote control display is adapted to display gaming information such as awards obtained, amounts wagered, queries as to the player's next gaming command, bonus information and advertisements for the present game as well as other games. For example, as illustrated in FIGS. 4A and 4B, the display device displays the player's current amount of credits as well as the amount of credits wagered. The remote control display device is also adapted to display any suitable information or data, such as personal messaging from, for example, a casino or individual or advertisements.

In one alternative embodiment, the remote control unit includes at least one sound generating device controlled by one or more sounds cards which function in conjunction with the microprocessor. In one embodiment, the sound generating device includes at least one speaker mounted in the housing for generating sounds relating to the use of the remote control unit.

In one embodiment, the remote control unit is adapted to receive a wireless signal through the communication port. In this embodiment, the remote control includes at least one signal receiver 120 mounted to the housing adjacent to the communication port and in communication with the microprocessor. When a wireless signal is sent to the remote control unit from the gaming device or other source, the signal receiver receives the wireless signals and sends an electronic signal to the microprocessor containing the information or data encoded within the wireless signal. The microprocessor utilizes such information or data accordingly, such as storing information in the memory device of the remote control unit or causing the display device to display information to the player.

Using the Wireless System

To use the wireless signal system of one embodiment of the present invention, a player first obtains a remote control unit from a remote control distribution station, such as cashier cage, hotel front desk or other suitable location. In another embodiment, the player obtains the remote control unit from a central automated docking station. In this embodiment, the player deposits an appropriate amount of funding into the docking station and in return, the docking station provides the player with a remote control unit.

After obtaining the remote control unit, the player takes the remote control unit to a gaming device and points or directs the remote control unit towards the signal receiver. Once the signal transmitter of the remote control unit and the signal receiver of the gaming device are aligned, an initialization process begins automatically. In this embodiment, in response to positioning the remote control unit in proximity to the gaming device, without necessarily inserting the remote control unit into any portion of the gaming device, a wireless transmission link is established between the remote control unit and the gaming device and the initialization process begins. In one embodiment, the initialization process begins when the remote control unit is placed in or otherwise engages the input slot for a more secure initialization process.

In one embodiment, to begin the initialization process, the player presses a button on the remote control unit. A signal containing a personal identification code for the remote control unit is sent from the remote control unit to the signal receiver of the gaming device. The signal receiver of the gaming device reads the signal and sends an electronic signal to the gaming device processor. The processor interprets, stores and acknowledges the personal identification code. In one embodiment, for added security, the remote control unit is programmed with a security code which must be entered by the player prior to operation of the synchronized remote control unit. After the initialization process is complete, the gaming device and/or remote control unit notifies the player that the gaming device is ready to be operated by the remote control unit. The notification from the controller can be audio and/or visual. For example, the display device of the gaming device can display a message acknowledging the presence of the remote control unit. In another embodiment, the speakers of the gaming device and/or the remote control unit emit a sound or message indicating initialization has occurred. After the initialization process is complete, the remote control unit can be used in any conventional manner. For example, a player may press a button to send a gaming command, such as a command to spin a set of reels.

In this embodiment, once initialization process is complete, the gaming device accepts signals solely from the remote control unit having the specific personal identification code. This embodiment prevents other players from operating the gaming device using a different remote control unit. That is, only the initialized remote control may operate the specific gaming device and other players controlling other remote control devices may not operate the specific gaming device. By enabling only the initialized remote control unit to operate the specific gaming device, one embodiment of the present invention provides that when a player deposits funds into a specific gaming device, the funds may only be cashed out and transferred to the initialized remote control unit or as otherwise designated by the player with the remote control, and not another remote control controlled by another person or player.

In one embodiment, the display of the remote control unit displays any suitable information relating to playing the gaming device. For example, the display may display the gaming command sent by the player to the gaming device or the display may display a menu of options which a player chooses from. In another embodiment, the display may show any suitable information transmitted from the gaming device or other wireless signal source, such as player information, the number of credits the player has remaining, advertisements or messaging.

In one embodiment, the remote control unit is used as a part of a player information tracking system. In this embodiment, a player goes to a cashier cage or other casino location and purchases credits. The number of credits purchased is inputted into a tracking system memory device which is in communication with a tracking system processor. Other player information, such as social security number, hotel room information and previous wagering information may also be inputted into the tracking system memory device. The player is issued a remote control unit and the identification code for the issued remote control unit is inputted into the tracking system memory.

The player then takes the remote control unit to one of a plurality of gaming devices in the system. When the initialization process between the gaming device and the remote control unit takes place, the gaming device processor acknowledges the personal identification code for the remote control unit. The gaming device processor then communicates with the tracking system processor and downloads the player's information, including the number of credits purchased.

It should also be appreciated that in one alternative embodiment of the present invention, the remote control unit can be used to additionally provide remote gaming in other locations of the casino without operating with a specific gaming device on the casino floor. For instance, a player may be able to use the remote control to play wagering game on a gaming machine and then use the remote control to play one or more wagering game remotely from the gaming machine (or other gaming machines). In such embodiments, the remote control displays the outcome.

It should also be appreciated that in one embodiment, the use of the remote control unit with a gaming device in one embodiment may provide the player an advantage or one or more features of the gaming device. For example, the use of the remote control unit may provide a better paytable for the game, an opportunity to obtain one or more high value awards, an opportunity for bonus game, one ore more additional bonus games, additional free credits or activations, or any other suitable features.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device operable under control of processor, said gaming device comprising:

a housing;

a primary game operable upon a wager by a player;

a display device connected to said housing and operable to display said primary wagering game;

an input slot defined by said housing, wherein said input slot is configured to receive at least part of a removable wireless remote control device; and a signal receiver connected to said housing, wherein the processor is operable with said display device and said signal receiver to:

(a) execute an initialization process between the signal receiver and the wireless remote control device when the wireless remote control device is inserted in the input slot;

(b) receive at least one wireless signal generated from the initialized wireless remote control device after the initialized wireless remote control device is removed from the input slot;

(c) execute at least one gaming device command associated with a play of said primary game in response to said received wireless signal, wherein said gaming device command is at least partially based on said received wireless signal; and (d) provide any award to the player for said play of the primary game.

2. The gaming device of claim 1, wherein the wireless signal encodes a plurality of gaming commands for said primary game.

3. The gaming device of claim 1, wherein the wireless signal encodes player information.

4. The gaming device of claim 1, wherein the signal receiver is operable to receive radio signals.

5. The gaming device of claim 1, wherein the signal receiver is operable to receive infrared signals.

6. The gaming device of claim 1, wherein the processor is operable to verify information transferred from the initialized wireless remote control device with information received from a remote source.

7. The gaming device of claim 1, wherein at least a portion of the information represented by the received wireless signal is displayable on a display of the wireless remote control unit.

8. A method of initializing a wireless remote control unit with a gaming device, said method comprising:

(a) aligning said wireless remote control unit with a signal receiver within a slot of a housing of the gaming device;

(b) causing a signal to be sent from the wireless remote control unit to the signal receiver of the gaming device while the wireless remote control unit is aligned with the signal receiver within the slot, said signal containing synchronization data which enables the wireless remote control unit to operate the gaming device; and (c) causing the gaming device to receive said synchronization data, wherein once the gaming device and the wireless remote control unit are synchronized, the gaming device is operable with said wireless remote control unit for a designated period, and the wireless remote control unit is operable with said gaming device for the designated period.

9. The method of claim 8, wherein the synchronization data includes a personal identification number for the wireless remote control unit which enables the wireless remote control unit to operate the gaming device.

10. The method of claim 8, wherein the synchronization data contains player identification information or wager information.

11. The method of claim 8, wherein the wireless remote control unit and the gaming device are aligned by physical coupling.

12. The method of claim 8, wherein the signal is a radio signal.

13. The method of claim 8, wherein the signal is an infrared signal.

14. The method of claim 8, wherein the signal is a laser signal.

15. The method of claim 8, wherein the signal is a microwave signal.

16. The method of claim 8, wherein the signal contains advertisement data.

17. The method of claim 8, wherein the signal contains personal messages.

* * * * *

UNITED STATES PATENT AND TRADEMARK OFFICE

CERTIFICATE OF CORRECTION

PATENT NO. : 8,241,127 B2
APPLICATION NO. : 11/204881
DATED : August 14, 2012
INVENTOR(S) : James K. Kovacs It is certified that error appears in the above-identified patent and that said Letters Patent is hereby corrected as shown below:

IN THE CLAIMS

In Claim 1, Column 18, Line 7, delete “wagering”.
In Claim 7, Column 18, Line 45, delete the first instance of “the”.

Signed and Sealed this
Eighteenth Day of December, 2012

David J. Kappos

David J. Kappos
*Director of the United States Patent and Trademark Office*